US009711307B2

(12) United States Patent
Weiden

(10) Patent No.: US 9,711,307 B2
(45) Date of Patent: Jul. 18, 2017

(54) MAGNETICALLY DRIVEN TRIP MECHANISM FOR AN OVERLOAD RELAY

(71) Applicant: SCHNEIDER ELECTRIC USA, INC., Palatine, IL (US)

(72) Inventor: Conrad S. Weiden, Chapel Hill, NC (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 295 days.

(21) Appl. No.: 14/526,863

(22) Filed: Oct. 29, 2014

(65) Prior Publication Data

US 2016/0126039 A1 May 5, 2016

(51) Int. Cl.
*H01H 36/00* (2006.01)
*H01H 37/52* (2006.01)
(Continued)

(52) U.S. Cl.
CPC ..... *H01H 36/0073* (2013.01); *H01H 37/52* (2013.01); *H01H 71/32* (2013.01);
(Continued)

(58) Field of Classification Search
CPC ..... H01H 36/0073; H01H 37/52; H01H 37/5409; H01H 36/0006; H01H 2036/0086; H01H 2071/665; H01H 75/00; H01H 73/00; H01H 2071/109; H01H 37/66; H01H 37/58; H01H 2001/0042; H01H 37/60; H01H 33/182; H01H 33/187; H01H 2071/168; H01H 35/2621; H01H 2221/04;
(Continued)

(56) References Cited

U.S. PATENT DOCUMENTS 2,951,129 A 8/1960 Mink
3,194,912 A 7/1965 Mink
(Continued)

FOREIGN PATENT DOCUMENTS

EP 2190102 5/2010
EP 2581256 4/2013

OTHER PUBLICATIONS

Extended European Search Report for Application No. 15186544.1-1808 dated Mar. 17, 2016.

*Primary Examiner* — Jayprakash N Gandhi
*Assistant Examiner* — Stephen Sul
(74) *Attorney, Agent, or Firm* — Locke Lord LLP

(57) ABSTRACT

In an overload relay, a tripping actuator 12 has a first magnet 18 and a moveable contact carrier 20 has a second magnet 28 mounted opposed to the first magnet. A moveable contact 22 on the moveable contact carrier is urged by repulsion between the magnets, to make a normally closed connection with a stationary contact 24, when the tripping actuator is in an ON position 15 and the contact carrier in a first stable position 26'. The magnets pass through an over-center tripping position (T) when the tripping actuator is moved to an OFF position 23 in response to an overcurrent condition sensed by a bimetallic thermal overload sensor 16. The magnets repel each other after passing through the over-center tripping position, to thereby urge the moveable contact into a second stable position 26, away from the stationary contact, to break the normally closed connection with the stationary contact.

11 Claims, 4 Drawing Sheets

(51) Int. Cl.

| | |
|---|---|
| ***H01H 71/32*** | (2006.01) |
| *H01H 61/02* | (2006.01) |
| *H01H 71/16* | (2006.01) |
| *H01H 51/22* | (2006.01) |

(52) U.S. Cl.
CPC ..... *H01H 61/02* (2013.01); *H01H 71/16* (2013.01); *H01H 71/164* (2013.01); *H01H 71/323* (2013.01); *H01H 2051/2218* (2013.01)

(58) Field of Classification Search
CPC ..... H01H 2221/048; H01H 36/00; H01H 43/308; H01H 5/02; B81B 3/0024; G01K 5/62; G05D 23/2754; H01F 7/00
USPC ..... 337/99, 134, 13, 42, 105, 343, 344, 365, 337/366, 367, 390, 12, 53, 54, 90, 98, 337/136, 318, 281, 400, 411
See application file for complete search history.

(56) References Cited

U.S. PATENT DOCUMENTS

| | | | | |
|---|---|---|---|---|
| 4,296,394 | A | 10/1981 | Ragheb | |
| 4,739,291 | A | 4/1988 | Lee et al. | |
| 4,888,531 | A * | 12/1989 | Hormann | E05F 15/70 318/282 |
| 5,332,986 | A | 7/1994 | Weiloch | |
| 5,502,426 | A | 3/1996 | Blanchard et al. | |
| 5,777,536 | A | 7/1998 | Lee et al. | |
| 8,222,982 | B2 | 7/2012 | Sullivan et al. | |
| 8,558,504 | B2 | 10/2013 | Brown et al. | |
| 2004/0036565 | A1* | 2/2004 | Farrey | H01H 37/56 335/207 |
| 2006/0231545 | A1* | 10/2006 | Lamb | H05B 3/74 219/448.16 |
| 2009/0278639 | A1* | 11/2009 | Chao | H01H 36/0073 335/207 |
| 2010/0245018 | A1* | 9/2010 | Furuhata | H01H 71/1054 337/37 |
| 2011/0297518 | A1* | 12/2011 | Baujan | H01H 71/7409 200/17 R |
| 2012/0001706 | A1 | 1/2012 | Heckenkamp et al. | |
| 2012/0287542 | A1 | 11/2012 | Bianco | |
| 2013/0106203 | A1* | 5/2013 | Nakagawa | H02K 41/035 310/12.26 |
| 2014/0015487 | A1 | 1/2014 | Brown et al. | |
| 2014/0035527 | A1 | 2/2014 | Hayashigawa et al. | |
| 2014/0203777 | A1 | 7/2014 | Flack | |
| 2015/0294825 | A1* | 10/2015 | Zhou | H01H 73/36 335/41 |

* cited by examiner

MAGNETICALLY DRIVEN TRIP MECHANISM FOR AN OVERLOAD RELAY

BACKGROUND OF THE INVENTION

1. Field of the Invention

The invention disclosed relates to trip mechanism for overload relays.

2. Discussion of the Related Art

Overload relays are intended to protect motors conductors against excessive heating due to prolonged motor overcurrents up to and including locked rotor currents. Overload relays are distinguished from circuit breakers, in that circuit breakers typically protect other types of branch-circuit components from higher currents acting over a shorter interval, due to short circuits or grounds.

Thermal overload relays sense prolonged motor overcurrent by converting this current to heat in a resistance element. The heat generated is used to open a normally closed contact in series with a starter coil causing the motor to be disconnected from the line.

Generally, there are three types of overload relays, the melting alloy thermal overload relay, the bimetallic thermal overload relay, and the solid state overload relay.

In melting alloy thermal overload relays, the motor current passes through a small heater winding. Under overload conditions, the heat causes a special solder to melt, tripping the relay and opening the normally closed contact in series with a starter coil causing the motor to be disconnected from the line.

Bimetallic thermal overload relays employ a bimetal strip associated with a current carrying heater coil. When an overload occurs, the heat will cause the bi-metal to deflect and trip the relay, opening the normally closed contact in series with a starter coil causing the motor to be disconnected from the line.

Solid state electronic overload relays do not require thermal units, instead use current transformers that respond directly to the motor current. Once an overload condition is reached, the electronic circuit of the overload relay trips, causing the contacts to open in a manner similar to the bimetallic thermal overload relay, opening the normally closed contact in series with a starter coil causing the motor to be disconnected from the line.

The normally closed contact in existing overload relays is typically driven by a mechanical bi-stable spring that is tripped by a complex sequence of levers that are difficult to manufacture because of the tolerances they require. Spring actuated bi-stable mechanisms can be difficult to dimension correctly making it difficult to guaranty consistent tripping positions and contact forces. What is needed is a simplified overload tripping mechanism the replaces the mechanical bi-stable spring with a mechanism that does not require difficult manufacturing steps.

SUMMARY OF THE INVENTION

The subject invention provides a simplified overload tripping mechanism for an overload relay, by replacing the mechanical bi-stable spring with two opposing magnets. The magnetically driven trip mechanism is relatively easy to manufacture and provides consistent tripping positions and contact forces in an overload relay. The invention comprises a tripping actuator having a first permanent magnet and a moveable contact carrier having a second permanent magnet mounted in an opposed orientation to the first permanent magnet. A moveable electrical contact on the moveable contact carrier is urged, by repulsion between the magnets, to make electrical connection with a stationary electrical contact, when the tripping actuator is in an ON position and the moveable contact carrier in a first stable position.

The overload relay may use an overcurrent sensing mechanism, such as a bimetallic thermal overload sensor that employs a bimetal strip associated with a current carrying heater coil. The heater coil may be connected in series with a power source and a motor. The bimetal strip is configured to deflect from heat produced by the heater coil when an overcurrent condition occurs. The bimetal strip is connected to the tripping actuator and when an overcurrent condition is sensed, it moves the tripping actuator.

When the tripping actuator is moved to an OFF position in response to an overcurrent condition being sensed by the bimetallic thermal overload sensor, the first permanent magnet passes the second permanent magnet in a first direction through an over-center tripping position. The proximity of the first and second permanent magnets causes them to repel each other and urge the moveable contact carrier and its moveable contact toward a second stable position, moving away from the stationary contact in an opposite, second direction, to break the normally closed electrical connection with the stationary electrical contact. The opposing magnets provide the over-center trip function and apply the proper force to open the contacts.

The invention may include an auto-reset mode to automatically restore the normally closed electrical connection with the stationary electrical contact, after an interval has passed since the overcurrent condition has subsided. When the overcurrent condition subsides and the heater coil cools, the bimetal strip is configured to reverse its deflection, thereby moving the tripping actuator in the second direction, back through the over-center tripping position. The first and second magnets repel each other, to thereby urge the moveable contact carrier and its moveable contact to return toward the first stable position, to make the normally closed electrical connection with the stationary electrical contact. In the auto-reset mode, the contact carrier is blocked in a position so that it cannot move to the full off position, so that when the tripping actuator returns, it can cause the reset automatically. Without the contact carrier blocked, it moves to a position where the tripping actuator cannot move far enough to cause auto reset and a reset button may then be used The invention may include an adjustable mount supporting the first magnet, to enable changing the location of the over-center tripping position by adjusting the orientation of the magnet, to thereby change the set point and sensitivity of the mechanism.

BRIEF DESCRIPTION OF THE FIGURES

Example embodiments of the invention are depicted in the accompanying drawings that are briefly described as follows.

DETAILED DESCRIPTION OF EMBODIMENTS OF THE INVENTION

Figure 1:
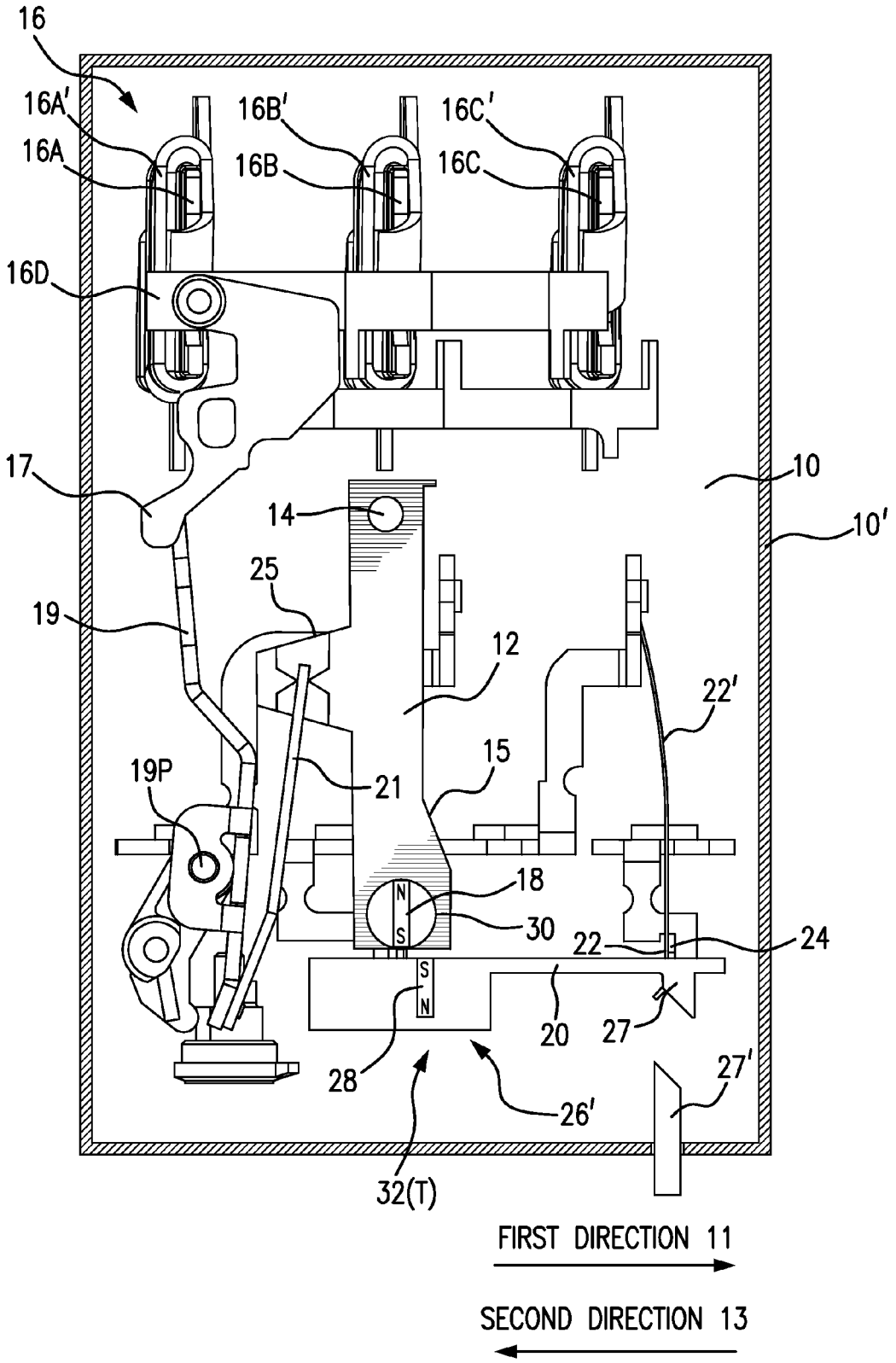
FIG. 1 shows a magnetically driven trip mechanism for an overload relay in a normally closed or ON state, wherein a tripping actuator is shown resting in an ON position and a moveable contact carrier is in a first stable position, while there is no overcurrent condition being sensed by a bimetallic thermal overload sensor.

FIG. 1 shows a magnetically driven trip mechanism for an overload relay in a normally closed or ON state. In an example embodiment of the invention, the overload relay may be contained in a housing 10'. In an example embodiment of the invention, the overload relay may use an overcurrent sensing mechanism, such as a bimetallic thermal overload sensor 16 that employs a bimetal strip 16A associated with a current carrying heater coil 16A'. The heater coil may be connected in series with one phase of a power source and a motor. The bimetallic thermal overload sensor 16 shown in the figure, employs three bimetal strips 16A, 16B and 16C, one for each phase of a three phase power system. Each bimetal strip 16A, 16B and 16C is associated with a respective heater 16A', 16B' and 16C'. Each bimetal strip, for example 16A, is configured to deflect from heat produced by its heater coil 16A' when an overcurrent condition occurs in that phase. When any one of the three bimetal strips 16A, 16B and 16C heats due to overcurrent, it bends to the right in the figure, pulling the displacement bar 16D and lever 17 with it. The displacement bar 16D and lever 17 push on the bimetal compensation lever assembly 19 and 21, causing it to rotate clockwise about a pivot 19P. When the bimetal compensation lever assembly 19 and 21 rotates clockwise, lever 21 pushes on the bimetal compensation subassembly link or interface 25, referred to herein by the shorter expression "bimetal interface" 25, of the tripping actuator 12. Thus, when an overcurrent condition is sensed, bimetal interface 25 moves the tripping actuator 12.

In the example embodiment, the tripping actuator 12 is mechanically coupled in this manner to the bimetallic thermal overload sensor 16. The tripping actuator 12 has a pivoted end mounted on a pivot 14 on a base 10 in the housing 10'. The tripping actuator 12 is shown in FIG. 1, resting in an ON position 15 while there is no overcurrent condition being sensed by the bimetallic thermal overload sensor 16. In alternate embodiments of the invention, the tripping level may have a linear sliding motion with respect to the contact carrier.

The tripping actuator 12 has a first permanent magnet 18 mounted on an end opposite to the pivoted end, with north-south poles of the first permanent magnet 18 oriented in a substantially radial direction with respect to the pivot 14. The first permanent magnet 18 moves in the first direction 11 when the bimetallic thermal overload sensor 16 causes the tripping actuator 12 to move in the first direction 11 in response to an overcurrent condition being sensed by the bimetallic thermal overload sensor 16. When an overload occurs, the heat will cause the bimetal strip 16A to deflect and move the tripping actuator 12 in the first direction 11.

A moveable contact carrier 20 is slideably mounted on the base 10. The moveable contact carrier 20 includes a moveable electrical contact 22 of the overload relay. The moveable electrical contact 22 may be on or actuate the contact carrier 20. The moveable electrical contact 22 may be located near the end of a flexible conductor wire 22'. The moveable electrical contact 22 is in a normally closed electrical connection with a stationary electrical contact 24 of the overload relay, as shown in FIG. 1, when the moveable contact carrier 20 is in a first stable position 26' on the base 10. The moveable contact carrier 20 has a second permanent magnet 28 mounted thereon, with north-south poles of the second permanent magnet 28 being oriented in a substantially opposite direction with respect to the direction of orientation of the north-south poles of the first permanent magnet 18. The first permanent magnet 18 and the second permanent magnet 28 repel one other to urge the moveable electrical contact 22 in the first direction 11 toward the stationary electrical contact 24 in the normally closed electrical connection of FIG. 1, when the moveable contact carrier 20 is in the first stable position 26' on the base 10 and the tripping actuator 12 is resting in the ON position 15 of FIG. 1.

Figure 2:
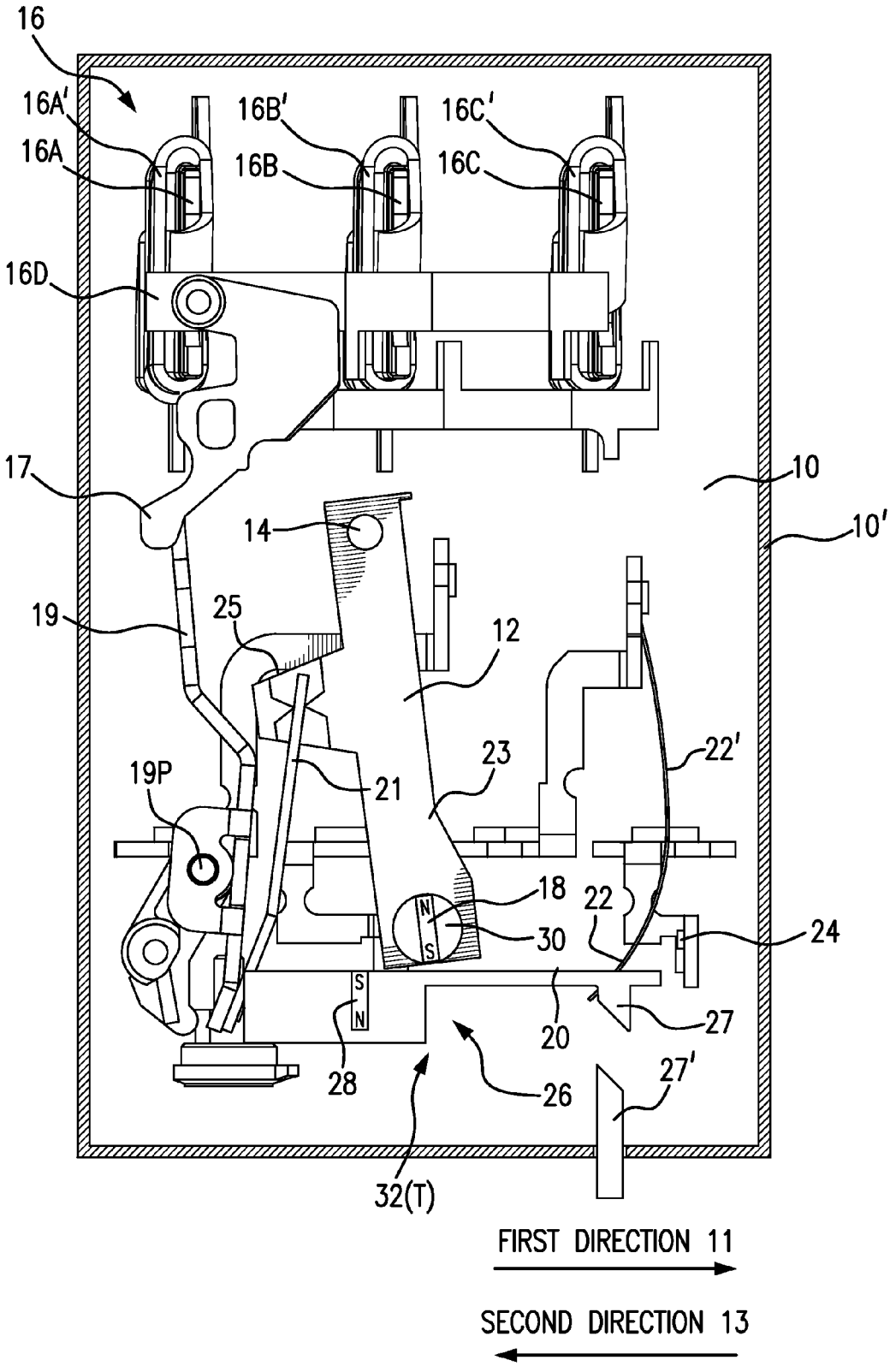
FIG. 2 shows the magnetically driven trip mechanism for the overload relay of FIG. 1, with the relay in an open or OFF state, wherein the tripping actuator is shown in an OFF position and the moveable contact carrier is in a second stable position, in response to an overcurrent condition being sensed by the bimetallic thermal overload sensor.

FIG. 2 shows the magnetically driven trip mechanism for an overload relay of FIG. 1, with the relay in an open or OFF state, wherein the tripping actuator 12 is shown in an OFF position 23 in response to an overcurrent condition being sensed by the bimetallic thermal overload sensor 16. The tripping actuator 12 moves in the first direction 11 to the OFF position 23 in FIG. 2, in response to an overcurrent condition being sensed by the bimetallic thermal overload sensor 16. The bimetal strip is configured to deflect from heat produced by the heater coil when an overcurrent condition occurs, thereby moving the tripping actuator 12 in the first direction 11, through the over-center tripping (T) position 32.

The first permanent magnet 18 passes through the over-center tripping (T) position 32 when the first permanent magnet 18 moves in the first direction 11 past the second permanent magnet 28. Their proximity causes the first permanent magnet 18 and the second permanent magnet 28 to repel each other and urge the moveable contact carrier 20 and its moveable electrical contact 22 to slide in the second direction 13 toward a second stable position 26 away from the stationary electrical contact 24, as shown in FIG. 2. This causes the moveable electrical contact 22 to break the normally closed electrical connection with the stationary electrical contact 24 of the overload relay.

FIGS. 1 and 2 show an auto-reset embodiment of the invention. After the overcurrent condition subsides and the heater coil cools in the bimetallic thermal overload sensor 16, the tripping actuator 12 returns to rest in the ON position 15 in FIG. 1. In this mode, the cooling of the bimetal strip 16A causes it to reverse its deflection and go to the left in the figure. The displacement bar 16D and lever 17 pull on the bimetal compensation lever assembly 19 and 21, causing it to rotate counter-clockwise about the pivot 19P. When the bimetal compensation lever assembly 19 and 21 rotates counter-clockwise, lever 21 pulls on the bimetal interface 25 of the tripping actuator 12, in the second direction 13 back through the over-center tripping (T) position 32.

As the tripping actuator 12 returns to rest in the ON position 15 in FIG. 1, the first permanent magnet 18 and the second permanent magnet 28 pass through the over-center tripping (T) position 32 as the first permanent magnet 18 moves in the second direction 13 past the second permanent magnet 28. This causes the first permanent magnet 18 and the second permanent magnet 28 to repel each other and urge the moveable contact carrier 20 toward the first stable position 26' in FIG. 1, with its moveable electrical contact 22 moving in the first direction 11 toward the stationary electrical contact 24. In this manner, the moveable contact carrier 20 automatically makes the normally closed electrical connection with the stationary electrical contact 24 of the overload relay.

An adjustable mounting 30 on the tripping actuator 12 supports the first magnet 18. The degree of repulsion between the first permanent magnet 18 and the second permanent magnet 28 may be adjusted by rotating the adjustable mounting 30 to change the orientation of the first magnet 18 in the adjustable mounting 30, thereby changing a location of the over-center tripping (T) position 32, and the set point and sensitivity of the mechanism.

A manual reset button 27' (FIGS. 1 and 2) may be juxtaposed with a wedge-shaped projection 27 (FIGS. 1 and 2) on the moveable contact carrier 20. The manual reset button 27' may be configured to move the moveable contact carrier 20 and the moveable electrical contact 22 toward the stationary electrical contact 24, to restore the normally closed electrical connection with the stationary electrical contact 24 of the overload relay.

Figure 3C:
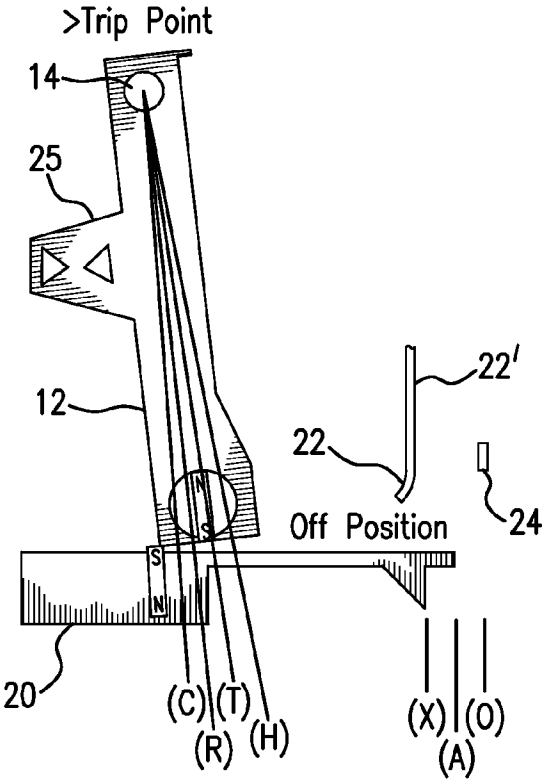
FIGS. 3A, 3B, and 3C show the contact carrier having three possible stable Positions: Off (X), Automatic reset (A) and On (O). When pushed during an overload condition, the tripping actuator will rotate until it just passes the over-center tripping (T) position, causing the contact carrier to move to the OFF (X) position.
Figure 3B:
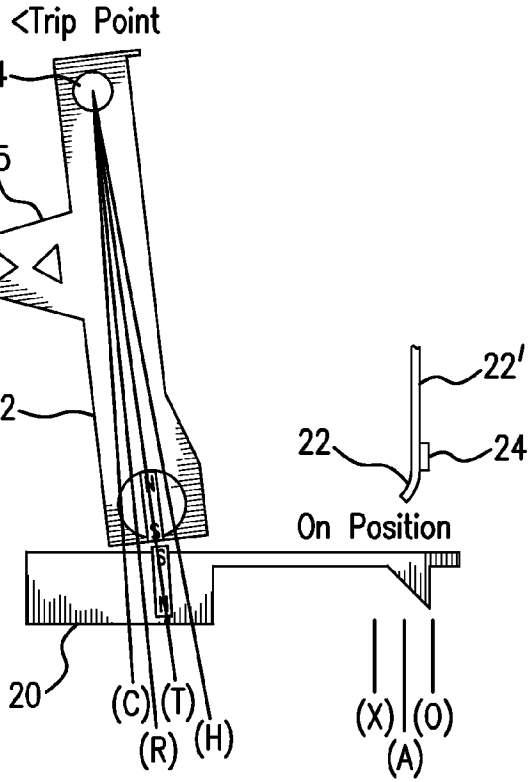
Figure 3A:
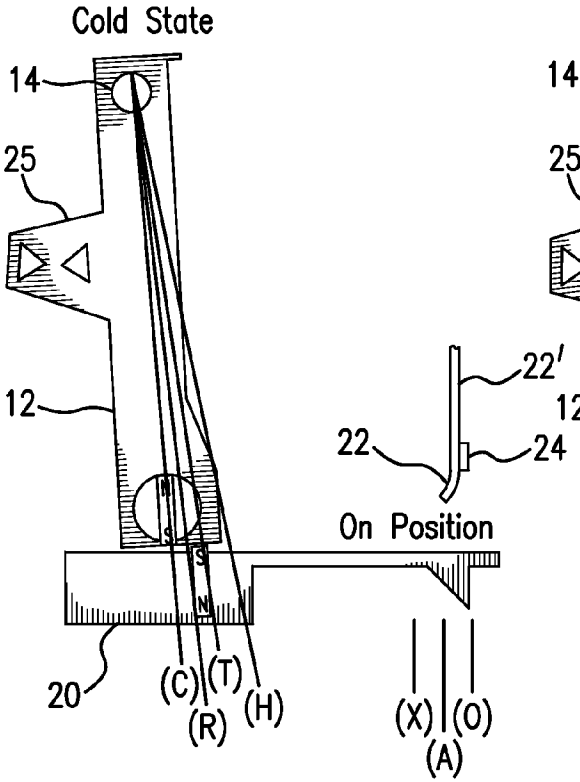

FIGS. 3A, 3B, and 3C show the contact carrier having three possible stable Positions: Off (X), Automatic reset (A) and On (O). When pushed (or pulled) by the bimetal compensation lever assembly 19 and 21 (FIG. 2), the tripping actuator 12 rotates in an arc from the cold state (C) position in FIG. 3A, through the over-center tripping (T) position in FIG. 3B, to the Hot state (H) position in FIG. 3C, and back. Going from the Cold state (C) to Hot state (H), there are two other positions, the over-center tripping (T) position and the reset (R) position. When pushed during an overload condition, the tripping actuator 12 will rotate until it just passes the over-center tripping (T) position, causing the contact carrier 20 to move to the OFF (X) position.

Figure 4B:
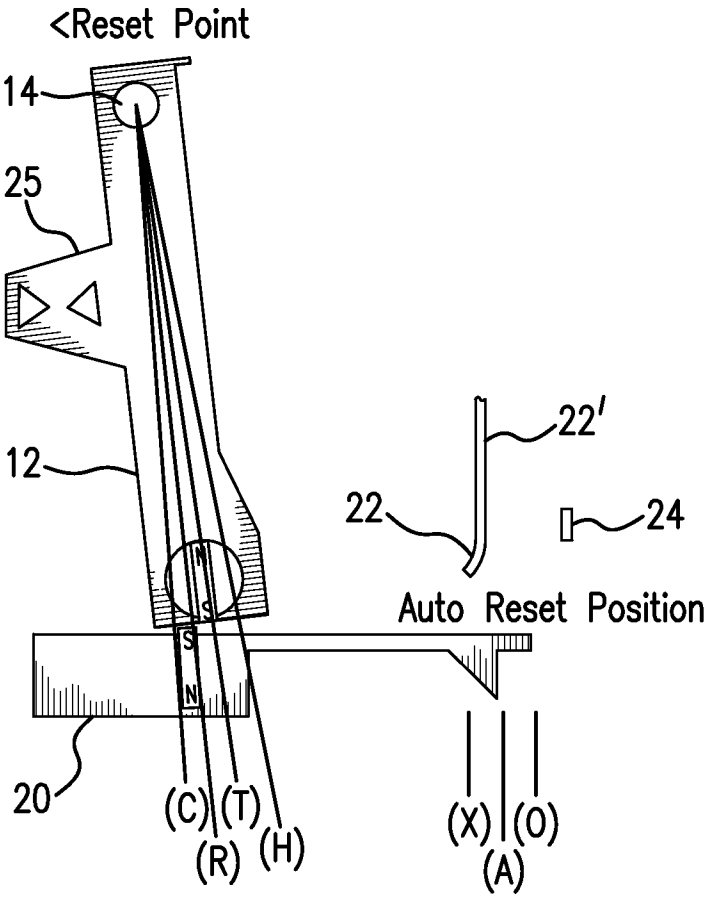
FIGS. 4A and 4B show when the bimetal strip starts to cool down in the Off (X) position, the tripping actuator may return to an automatic reset (A) position, in an auto-reset embodiment of the invention. The contact carrier will automatically move to the On (O) position as soon as the bimetal strip cools to the point where it has pulled the tripping actuator back to a Reset (R) position.
Figure 4A:
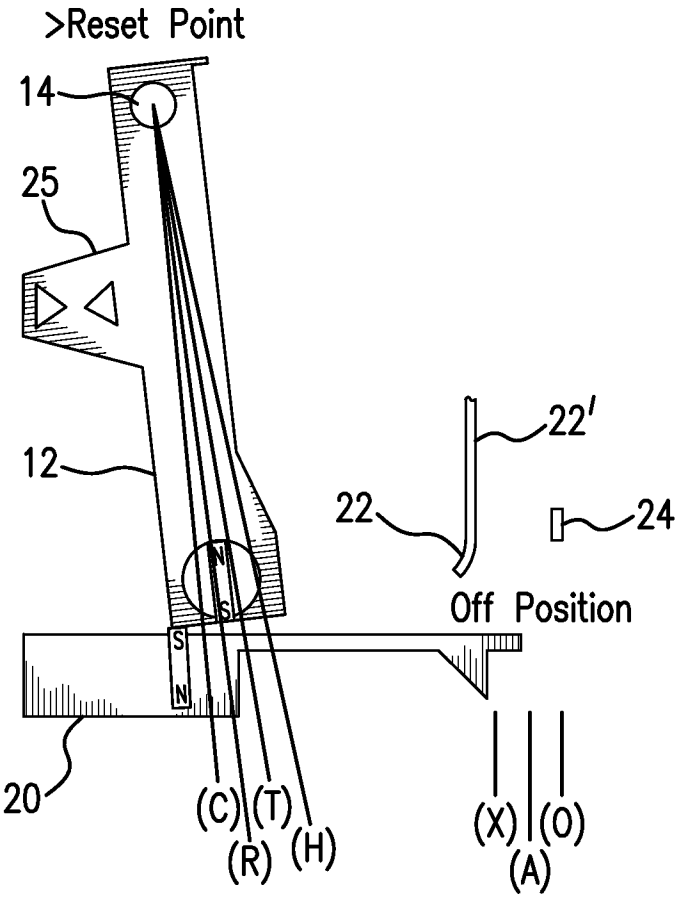

FIGS. 4A and 4B show when the bimetal strip 16A, for example, starts to cool down in the Off (X) position of FIG. 4A, and the tripping actuator 12 returns to the reset (R) position. A reset button 27' (FIG. 2) may be pushed to cause the contact carrier 20 to return to the On (O) Position. The reset button 27' may be dimensioned so that it can not push the contact carrier 20 past the over-center tripping (T) position until the bimetal strip 16A, for example, has cooled to a level that would indicate it is safe to start the motor again.

In the auto-reset embodiment shown in the figures, there is also an automatic reset (A) position of FIG. 4B, where the contact carrier 20 is blocked in a position so that it cannot move to the full Off (X) position. In this mode, the contact carrier 20 will move to the On (O) position as soon as the bimetal strip 16A, for example, cools to the point where it has pulled the tripping actuator 12 back to the Reset (R) position. This blocked position is basically the same point to which the reset button 27' would move the contact carrier 20.

In an alternate example embodiment of the invention, the moveable contact carrier 20 may further include a second moveable electrical contact (not shown) on or actuated by the moveable contact carrier 20. The second moveable electrical contact may be configured to be urged, by the repulsion between the first and second permanent magnets 18 and 28, to remain disconnected in a normally open electrical connection with a second stationary electrical contact (not shown), when the tripping actuator 12 is in the ON position 15 and the moveable contact carrier 20 in the first stable position 26'. The second moveable electrical contact may be configured to make a connection with the second stationary electrical contact in the normally open electrical connection, when the first permanent magnet 18 passes the second permanent magnet 28 in the first direction 11 through the over-center tripping (T) position 32. This occurs when the tripping actuator 12 is moved to the OFF position 23 and the moveable contact carrier 20 is in the second stable position 26 in response to the overcurrent condition being sensed by the overcurrent sensing mechanism 16. The second moveable electrical contact may be configured to break the connection with the second stationary electrical contact in the normally open electrical connection, when the first permanent magnet 18 passes the second permanent magnet 28 in the second direction 13 through the over-center tripping (T) position 32. This occurs when the tripping actuator 12 is moved to the ON position 15 and the moveable contact carrier 20 is in the first stable position 26', in response to the overcurrent condition being sensed to subside, by the overcurrent sensing mechanism 16.

The overcurrent sensing mechanism of the present invention might use any one of a melting alloy thermal overload sensor, a bimetallic thermal overload sensor, or a solid state overload sensor.

Although specific example embodiments of the invention have been disclosed, persons of skill in the art will appreciate that changes may be made to the details described for the specific example embodiments, without departing from the spirit and the scope of the invention.

The invention claimed is:

1. A magnetically driven trip mechanism for an overload relay, comprising:

a tripping actuator having a first permanent magnet;

a moveable contact carrier having a second permanent magnet mounted in an opposed orientation to the first permanent magnet;

a moveable electrical contact on or actuated by the moveable contact carrier, the moveable electrical contact configured to be urged, by repulsion between the first and second permanent magnets, to make a normally closed electrical connection with a stationary electrical contact, when the tripping actuator is in an ON position and the moveable contact carrier in a first stable position;

the first permanent magnet passing the second permanent magnet in a first direction through an over-center tripping position when the tripping actuator is moved to an OFF position in response to an overcurrent condition being sensed by an overcurrent sensing mechanism, the first permanent magnet propelling the second permanent magnet by mutual repulsion to move through the over-center tripping position; and the first and second permanent magnets being configured to repel each other after the first permanent magnet passes through the over-center tripping position, to thereby urge the moveable contact carrier and its moveable contact toward a second stable position, the moveable contact thereby moving in a second direction opposite to the first direction, to break the normally closed electrical connection with the stationary electrical contact, the first permanent magnet propelling the second permanent magnet by mutual repulsion to move through the over-center tripping position.

2. The magnetically driven trip mechanism for an overload relay of claim 1, further comprising:

the first permanent magnet passing the second permanent magnet in the second direction opposite to the first direction, through the over-center tripping position, when the tripping actuator is moved to an ON position after the overcurrent condition subsides; and the first and second permanent magnets being configured to repel each other after the first permanent magnet passes through the over-center tripping position in the second direction, to thereby urge the moveable contact carrier and its moveable contact toward the first stable position, the moveable contact thereby moving toward the stationary contact, to make the normally closed electrical connections with the stationary electrical contact.

3. The magnetically driven trip mechanism for an overload relay of claim 1, further comprising:

an adjustable mounting on the tripping actuator, the adjustable mounting supporting the first magnet, the repulsion between the first and second magnets being adjustable by changing the orientation of the first magnet in the adjustable mounting, thereby changing a location of the tripping position.

4. The magnetically driven trip mechanism for an overload relay of claim 1, wherein the overcurrent sensing mechanism is a bimetallic thermal overload sensor.

5. The magnetically driven trip mechanism for an overload relay of claim 1, wherein the overcurrent sensing mechanism is a bimetallic thermal overload sensor that employs a bimetal strip associated with a current carrying heater coil connected in series with a power source and a motor, the bimetal strip being configured to deflect from heat produced by the heater coil when an overcurrent condition occurs, thereby moving the tripping actuator in the first direction, through the over-center tripping position.

6. The magnetically driven trip mechanism for an overload relay of claim 5, wherein when the overcurrent condition subsides and the heater coil cools, the bimetal strip is configured to reverse its deflection, thereby moving the tripping actuator in the second direction, back through the over-center tripping position.

7. The magnetically driven trip mechanism for an overload relay of claim 1, wherein the tripping actuator has a pivoted end mounted on a pivot on a base, the tripping actuator having the first permanent magnet mounted on an end opposite to the pivoted end, with north-south poles of the first permanent magnet oriented in a substantially radial direction with respect to the pivot, the first permanent magnet moving in the first direction when the overcurrent sensing mechanism causes the tripping actuator to move in the first direction in response to the overcurrent condition being sensed by the overcurrent sensing mechanism; and wherein the moveable contact carrier is slideably mounted on the base, the moveable contact carrier having the second permanent magnet mounted thereon with north-south poles of the second permanent magnet being oriented in a substantially opposite direction with respect to the direction of orientation of the north-south poles of the first permanent magnet, the moveable contact carrier and its moveable electrical contact sliding in the second direction away from the stationary electrical contact, when the tripping actuator is moved to the OFF position in response to the overcurrent condition being sensed by an overcurrent sensing mechanism.

8. The magnetically driven trip mechanism for an overload relay of claim 1, wherein the overcurrent sensing mechanism is connected in series with a power source and a motor, the overcurrent sensing mechanism being configured to sense a prolonged motor overcurrent.

9. The magnetically driven trip mechanism for an overload relay of claim 1, wherein, in response to the overcurrent condition being sensed to subside by the overcurrent sensing mechanism, the tripping actuator moves in the second direction back through the over-center tripping position, thereby urging the contact carrier toward the first stable position and moving the moveable electrical contact in the first direction toward the stationary electrical contact, to thereby automatically reset the normally closed electrical connection with the stationary electrical contact.

10. The magnetically driven trip mechanism for an overload relay of claim 1, further comprising:

the moveable contact carrier further including a second moveable electrical contact on or actuated by the moveable contact carrier, the second moveable electrical contact configured to be urged, by the repulsion between the first and second permanent magnets, to remain disconnected in a normally open electrical connection with a second stationary electrical contact, when the tripping actuator is in the ON position and the moveable contact carrier in the first stable position;

the second moveable electrical contact configured to make a connection with the second stationary electrical contact in the normally open electrical connection, when the first permanent magnet passes the second permanent magnet in the first direction through the over-center tripping position, when the tripping actuator is moved to the OFF position and the moveable contact carrier is in the second stable position in response to the overcurrent condition being sensed by the overcurrent sensing mechanism.

11. The magnetically driven trip mechanism for an overload relay of claim 10, further comprising:

the second moveable electrical contact configured to break the connection with the second stationary electrical contact in the normally open electrical connection, when the first permanent magnet passes the second permanent magnet in the second direction through the over-center tripping position, when the tripping actuator is moved to the ON position and the moveable contact carrier is in the first stable position in response to the overcurrent condition being sensed to subside, by the overcurrent sensing mechanism.

* * * * *